US008177629B2

(12) United States Patent
Inamura

(10) Patent No.: US 8,177,629 B2
(45) Date of Patent: May 15, 2012

(54) GAME SYSTEM

(75) Inventor: Yukinori Inamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1426 days.

(21) Appl. No.: 11/207,773

(22) Filed: Aug. 22, 2005

(65) Prior Publication Data

US 2006/0046820 A1 Mar. 2, 2006

(30) Foreign Application Priority Data

Aug. 24, 2004 (JP) ..... 2004-243256

(51) Int. Cl.
*A63F 9/24* (2006.01)

(52) U.S. Cl. ..... 463/25; 463/16; 463/20; 463/29; 463/42

(58) Field of Classification Search ..... 463/27, 463/16, 25, 29, 42
See application file for complete search history.

(56) References Cited

U.S. PATENT DOCUMENTS

| | | | | |
|---|---|---|---|---|
| 4,837,728 | A * | 6/1989 | Barrie et al. | 463/27 |
| 4,856,787 | A * | 8/1989 | Itkis | 273/237 |
| 5,116,055 | A * | 5/1992 | Tracy | 463/27 |
| 5,564,700 | A | 10/1996 | Celona | |
| 5,816,918 | A * | 10/1998 | Kelly et al. | 463/16 |
| 5,885,158 | A * | 3/1999 | Torango et al. | 463/27 |
| 5,984,779 | A * | 11/1999 | Bridgeman et al. | 463/16 |
| 6,017,032 | A * | 1/2000 | Grippo et al. | 273/138.1 |
| 6,077,162 | A | 6/2000 | Weiss | |
| 6,224,484 | B1 | 5/2001 | Okuda et al. | |
| 6,416,409 | B1 * | 7/2002 | Jordan | 463/27 |
| 6,749,510 | B2 * | 6/2004 | Giobbi | 463/42 |
| 7,131,909 | B2 * | 11/2006 | Rowe | 463/42 |
| 2002/0010025 | A1 * | 1/2002 | Kelly et al. | 463/42 |
| 2002/0142846 | A1 * | 10/2002 | Paulsen | 463/43 |
| 2003/0060279 | A1 * | 3/2003 | Torango | 463/27 |
| 2003/0148808 | A1 | 8/2003 | Price | |
| 2003/0167230 | A1 * | 9/2003 | McCarthy | 705/40 |
| 2007/0191109 | A1 * | 8/2007 | Crowder et al. | 463/42 |

FOREIGN PATENT DOCUMENTS

| | | | |
|---|---|---|---|
| CA | 2150215 | | 11/1996 |
| CN | 1191032 | A | 8/1998 |
| EP | 1 063 622 | A2 | 12/2000 |
| EP | 1 380 998 | A2 | 1/2004 |
| JP | 2928493 | B2 | 12/1998 |
| JP | 11-104353 | | 4/1999 |
| JP | 2003-251067 | | 9/2003 |
| JP | 2004-135721 | | 5/2004 |
| WO | WO 02/05229 | A2 | 1/2002 |
| WO | WO 03/028830 | A1 | 4/2003 |

* cited by examiner

*Primary Examiner* — Omkar Deodhar
(74) *Attorney, Agent, or Firm* — Edwards Wildman Palmer LLP

(57) ABSTRACT

A game system includes a server and gaming machines each connected to the server via a network. The server stores therein game programs which are downloaded via the network to any one of the gaming machines so that a game program recorded in the gaming machine is changed. A predetermined percent of a bet value per on each of the gaming machines are accumulated, and the accumulated amount is awarded to any of the gaming machines satisfying a predetermined game condition, regardless of the kind of game programs recorded in the gaming machines.

15 Claims, 17 Drawing Sheets

GAME SYSTEM

CROSS REFERENCE TO RELATED APPLICATION

This application is based upon and claims the benefit of priority from the prior Japanese Patent Application No. 2004-243256, filed on August 24, the entire contents of which are incorporated herein by reference.

BACKGROUND OF THE INVENTION

1. Field of the Invention

The present invention relates to a game system in which a game program downloaded from a server can be executed in a gaming machine.

2. Description of the Related Art

In some game systems, game programs are stored in a server so that a player can select and enjoy a game corresponding one of the game programs on a gaming machine which is connected to the server (see Japanese Patent Unexamined Publications No. 2004-135721 and No. 2003-251067).

Some game systems have a jackpot function in which, for example, tens or hundreds of gaming machines each recording the same game program are linked and a certain percent of the amount of bet coins, i.e., a certain percent of a bet value, on all the gaming machines is accumulated. Thus, someone who makes a jackpot in one of the machines can be awarded whole of the accumulated amount as a bonus.

SUMMARY OF THE INVENTION

When such a jackpot function is applied to the former game system including a server and multiple gaming machines connected to the server, the accumulated amount in gaming machines recording a favored or popular game program gets higher and higher while the accumulated amount in gaming machines recording an unfavored or unpopular game program cannot get so high. Therefore, a player playing an unfavored or unpopular game is offered a poor opportunity to enjoy or expect the special pleasure of gaining a highly accumulated amount caused by making a jackpot.

It is an object of the invention to provide a game system which includes a server and gaming machines each connected to the server and downloading a game program from the server thereby to change a game program recorded therein and which can give a large amount as a bonus even to a player who plays a relatively unfavored or unpopular game.

A game system according to the present invention includes a server storing therein a plurality of game programs; a plurality of gaming machines each connected to the server via a network so as to download one of the game programs stored in the server via the network to change a game program recorded therein; an accumulating device that accumulates a predetermined percent of a bet value on each of the gaming machines; and an awarding device that awards an amount accumulated by the accumulating device to any of the gaming machines satisfying a predetermined game condition, regardless of the kind of game programs recorded in the gaming machines.

In the game system according to the present invention, a predetermined percent of a bet value on each of the gaming machines is accumulated, and the accumulated amount is awarded to any of the gaming machines satisfying a predetermined game condition, regardless of the kind of game programs recorded in the gaming machines. As a result, even a player who plays a relatively unfavored or unpopular game can obtain a large amount as a bonus.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings. This embodiment adopts, as an example, a gaming machine in which playing is performed with a game displayed on a display device. However, the present invention is not limited thereto, and a slot machine having rotatable reels, a pinball machine, or the like may be adopted as a gaming machine.

A "coin", which is used as a game medium in this embodiment, includes any of coin currencies circulating through a commercial scene of a country where the present invention is carried out, and game medals or tokens which are used exclusively in a game place where the present invention is applied and which are available to a player by exchange from a local currency of the country. However, a game medium is not limited to a coin. In a gaming machine such as a pinball machine, a game ball such as a pinball may be used. In a gaming machine using a magnetic card, an IC card, etc., which stores therein digital data of the amount of game medium, these digital data may be substituted for the coin.

First, referring to FIG. 1, the configuration of a game system according to an embodiment of the invention will be described.

Figure 1:
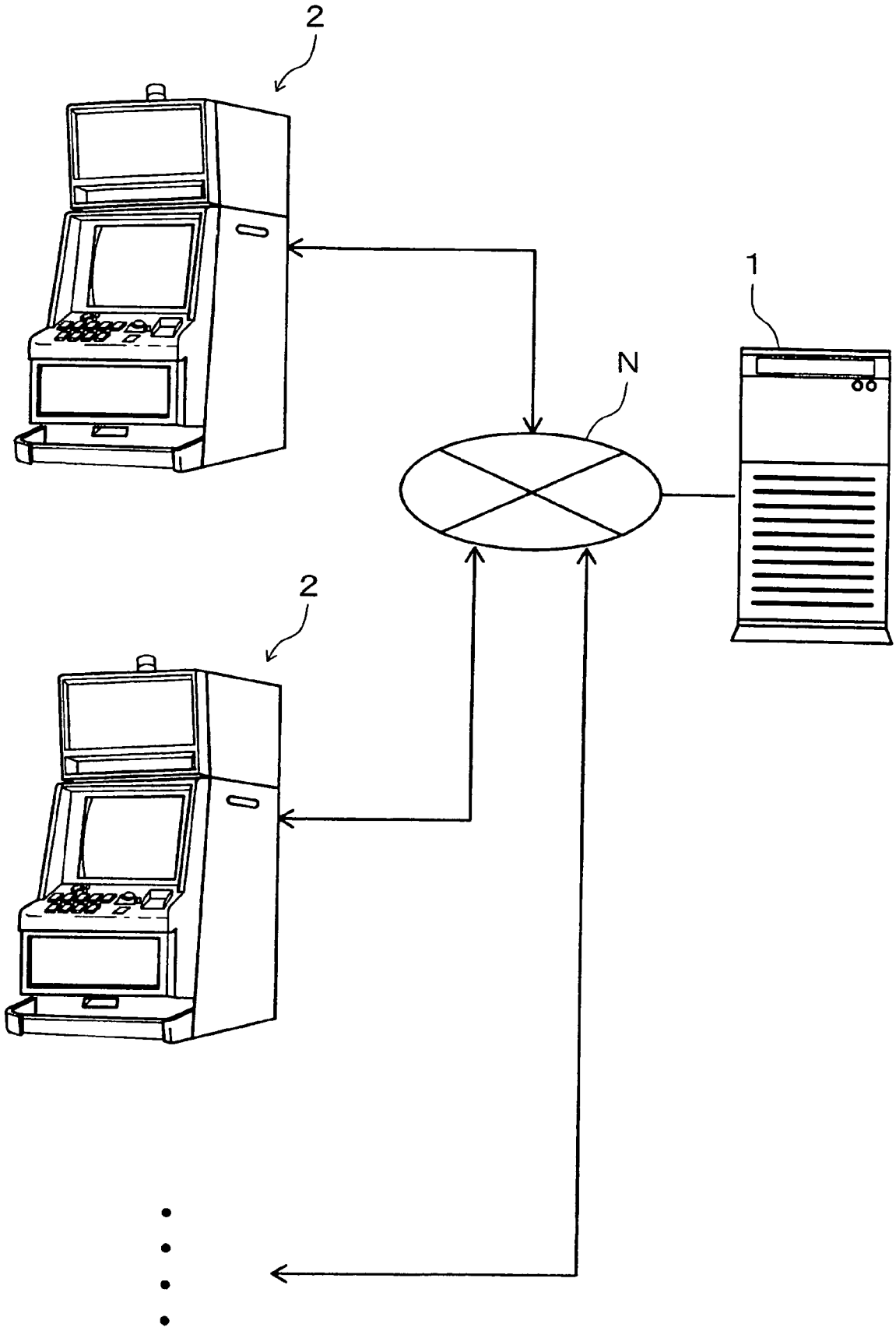
FIG. 1 shows a game system according to an embodiment of the invention in which a server and gaming machines are connected via a network.

As shown in FIG. 1, in the game system of this embodiment, a server 1 is connected to gaming machines 2 as communication terminals via a network N of communication lines such as a public telephone network or a local area network (LAN), so that the server 1 and the gaming machines 2 transmit and receive various information via the network N.

The server 1 monitors the gaming machines 2. Each of the gaming machines 2 is given its own identification number by which the server 1 determines a source of data coming from each gaming machine 2. The identification number is also used for designating a destination when the server 1 transmits a game program to a gaming machine 2 in order to change a game program recorded in the gaming machine 2, which will be detailed.

Figure 2:
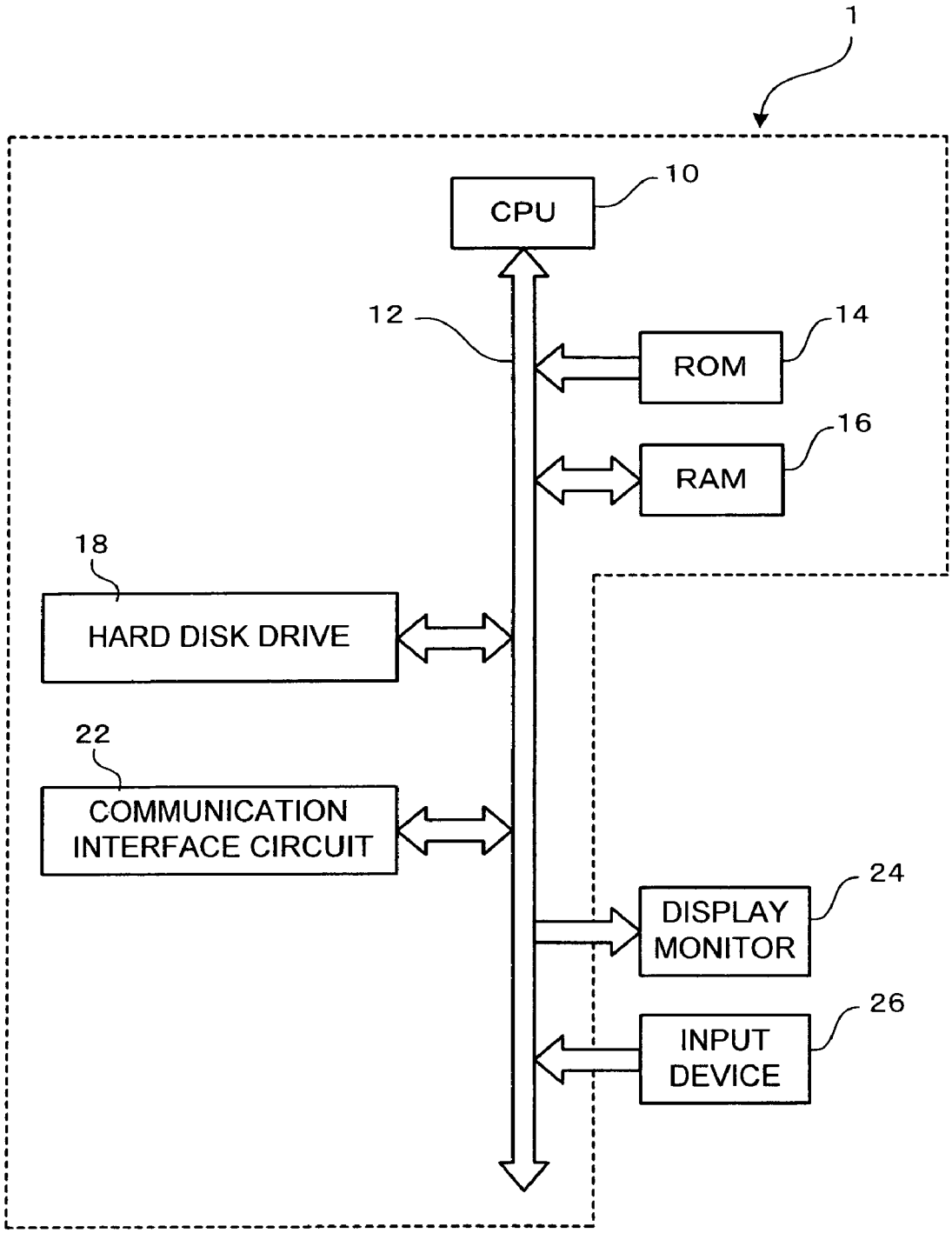
FIG. 2, is a block diagram showing an electrical configuration of the server.

Next, with reference to FIG. 2, an electrical configuration of the server 1 will be described.

The server 1 includes a central processing unit (CPU) 10. The CPU 10 is connected to an input-output bus 12 so that a data signal or an address signal can be inputted to or outputted from the CPU 10.

The input-output bus 12 is connected to a read-only-memory (ROM) 14 and a random-access-memory (RAM) 16. The ROM 14 stores therein a control program for controlling the server 1 which will be described later. The RAM 16 stores therein flag and variable values which are used in the control program, an "accumulated amount" which will be described later, and the like.

A hard disk drive 18 and a communication interface circuit 22 are also connected to the input-output bus 12. Stored in the hard disk drive 18 are game programs which are to be downloaded to and executed in the gaming machines 2, a database where data on a game condition in each gaming machine 2 which are transmitted from the gaming machine 2 are stored, and the like. The communication interface circuit 22 is used for communicating with the gaming machines 2 via the network N as shown in FIG. 1. The server 1 acts as a master station of the gaming machines 2, and is given an identification number "0000" for communication.

In this embodiment the hard disk drive 18 is used as a memory for storing the game programs, etc. However, the present invention is not limited thereto, and any memory device may be used as long as it is a large-capacity, nonvolatile, and rewritable one such as a flush memory.

Programs conducted by the server 1 include: (A) a program for controlling game conditions in the gaming machines 2, (B) a program for storing game programs which are to be downloaded to and executed by the gaming machines 2, and (C) a program for transmitting a gaming machine 2 a game program stored in the server 1 under predetermined conditions, thereby changing a game program recorded in the gaming machine 2.

A display monitor 24 and an input device 26 are also connected to the input-output bus 12. The display monitor 24 displays an image corresponding to data which are stored in the hard disk drive 18 of the server 1. The data include game conditions in gaming machines 2 connected via the network N to the server 1, the sum of coins inserted in and paid out, an operating rate of the gaming machines 2, and the like. The input device 26 sends the server 1 an instruction for transmitting a game program to any of the gaming machines 2, an instruction for changing the image displayed on the display monitor 24, and the like.

Figure 3:
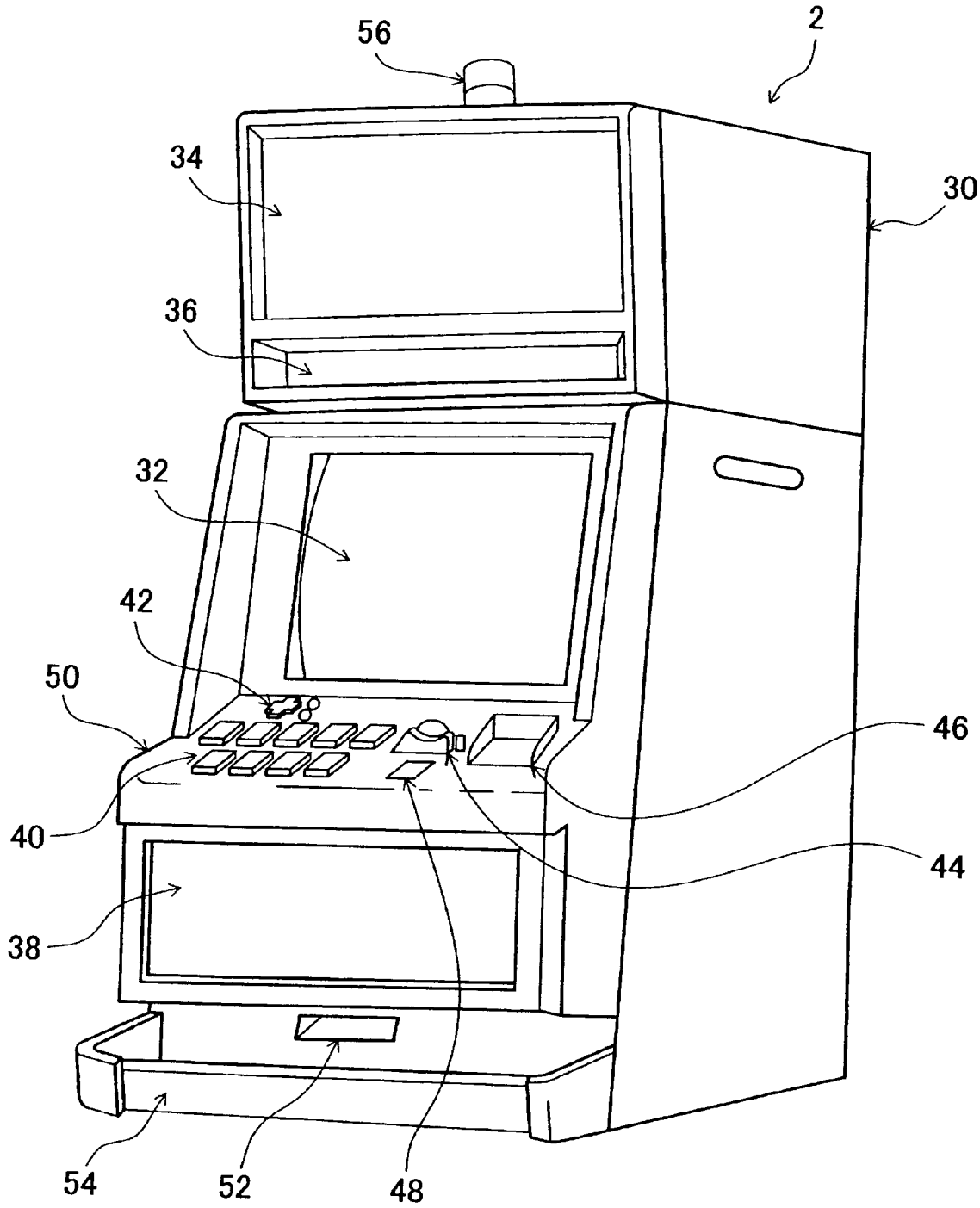
FIG. 3 is a perspective view of the gaming machine.

Next, with reference to FIG. 3, a construction of the gaming machine 2 will be described.

The gaming machine 2 includes a cabinet 30. A middle part of a front face of the cabinet 30 is inclined slightly rearward relative to the vertical direction. A main display device 32 is provided on the front face. The main display device 32 displays information about a game corresponding to a game program currently executed so that a player watches the main display device 32 while playing the game.

A sub display device 34 is also provided on the front face of the cabinet 30 and above the main display device 32. The sub display device 34 displays information on a rule of the game, information which cannot be displayed on the main display device 32, or the like. A screen display on the sub display device 34 changes depending on a game program currently executed. On the other hand, a conventional gaming machine generally has a manual of a game rule attached to a portion corresponding to the sub display device 34. Thus in this case, if one gaming machine can execute more than one game programs as this embodiment, rules of all games that can be played on the gaming machine should be written on the manual, which causes the manual to be large or bulky. The embodiment avoids such a problem by providing the sub display device 34 the screen display on which changes depending on a game program currently executed.

A sub display device 36 is provided between the main display device 32 and the sub display device 34. On the sub display device 36, characters or patterns can flash like an ornamental lamp in accordance with game conditions, or alternatively text information can be scrolled from right to left. A notification lamp 56 is provided on the cabinet 30.

A substantially horizontal base portion 50 is provided below the main display device 32. Switches 40 and a criss-cross-direction switch 42 are provided on the left-hand of an upper face of the base portion 50. These switches are used in order to give instructions such as selection and decision during a game.

On the right-hand of the upper face of the base portion 50, a coin insertion slot 44 and a bill insertion slot 46 are provided. When a coin or a bill is inserted into the corresponding slot, a game program gets ready to be executed.

Further, a payout switch 48 is disposed near the coin insertion slot 44. When the payout switch 48 is pressed, an inserted coin is paid out of a coin payout slot 52 provided at a lower part of the front face of the cabinet 30. The coin thus paid is received in a coin receiver 54.

In a lower part of the cabinet 30 above the coin payout slot 52, provided is a sub display device 38 on which various information can be displayed.

Figure 4:
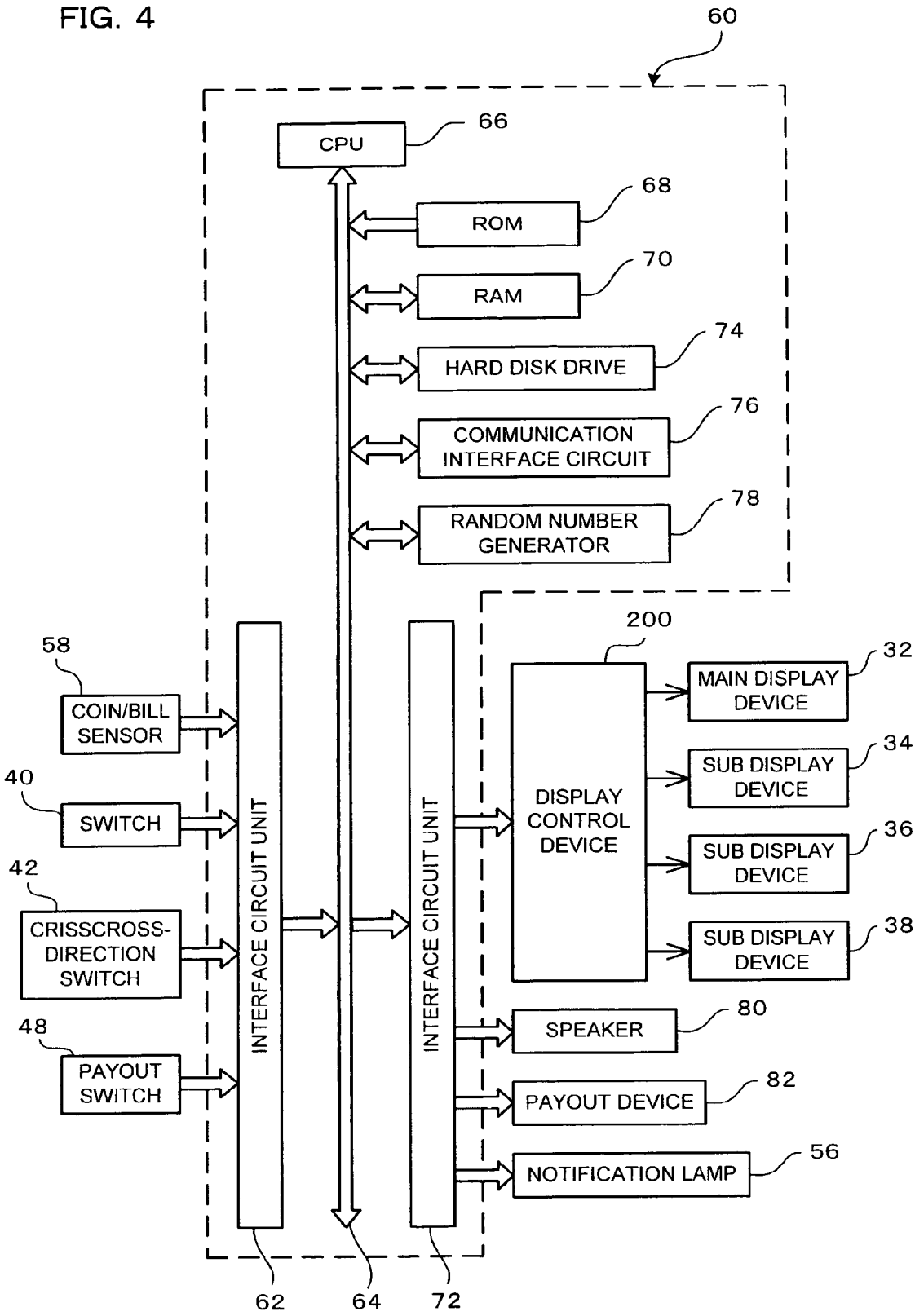
FIG. 4 is a block diagram showing an electrical configuration of the gaming machine.

Next, with reference to FIG. 4, an electrical configuration of the gaming machine 2 will be described.

The switches 40 and the crisscross-direction switch 42 are connected to an interface circuit unit 62 included in a main control circuit 60. The interface circuit unit 62 is connected to an input-output bus 64. The respective switches, when pressed, generate predetermined signals which are then supplied to the input-output bus 64. Through input-output bus 64, a data signal or an address signal is inputted to or outputted from the CPU 66.

A coin/bill sensor 58 for detecting a coin or a bill is also connected to the interface circuit unit 62. When a coin or a bill is inserted into the coin insertion slot 44 or the bill insertion slot 46, respectively, the coin/bill sensor 58 signals information about the kind and the number of inserted coins or bills, and a signal thus generated is supplied to the interface circuit unit 62.

The payout switch 48 is also connected to the interface circuit unit 62. When a player presses the payout switch 48, a predetermined signal is supplied from the payout switch 48 to the input-output bus 64, and in accordance with the signal an inserted coin is paid out of the coin payout slot 52.

The gaming machines 2 are given their own identification numbers for communication, based on which the sever 1 identifies the gaming machines 2.

A ROM 68 and a RAM 70 are connected to the input-output bus 64. The ROM 68 stores therein a control program for controlling the whole of the gaming machine 2. The ROM 68 also stores therein initial data for conducting the control program, a part of a program for controlling a display on the main display device 32, and the like. The RAM 70 stores therein flag and variable values which are used in the above-mentioned programs and later-described game programs.

A hard disk drive 74 is also connected to the input-output bus 64.

In this embodiment the hard disk drive 74 is used as a memory for recording the game programs, etc. However, the present invention is not limited thereto, and any memory device may be used as long as it is a large-capacity, nonvolatile, and rewritable one such as a flush memory.

An interface circuit unit 72 is also connected to the input-output bus 64. A speaker 80, a payout device 82, and the notification lamp 56 are connected to the interface circuit unit 72. In accordance with a result of a computing processing performed by the CPU 66, the interface circuit unit 72 supplies a drive signal or drive power to the aforesaid respective elements 80, 82, and 56 in order to control them.

When abnormality of the gaming machine 2 is detected, the notification lamp 56 lights or flashes in order that a player can call for a staff of a game shop.

A random number generator 78 is also connected to the input-output bus 64. When the CPU 66 commands the random number generator 78 to generate random numbers, the random number generator 78 generates a predetermined range of random numbers, and then gives the input-output bus 64 a signal representing these random numbers. Based on the random numbers thus generated, the CPU 66 determines how a game progresses. The random numbers generated by the random number generator 78 are, as data showing a lottery result, recorded in the RAM 70.

A communication interface circuit 76 connected to the input-output bus 64 is used for communicating with the server 1 via the network N as shown in FIG. 1.

A display control device 200 is also connected to the interface circuit unit 72. Based on an image display command which is given by the main control circuit 60, the display control device 200 issues drive signals for driving the main display device 32 and the sub display devices 34, 36, and 38 which are connected to the display control device 200.

Figure 5:
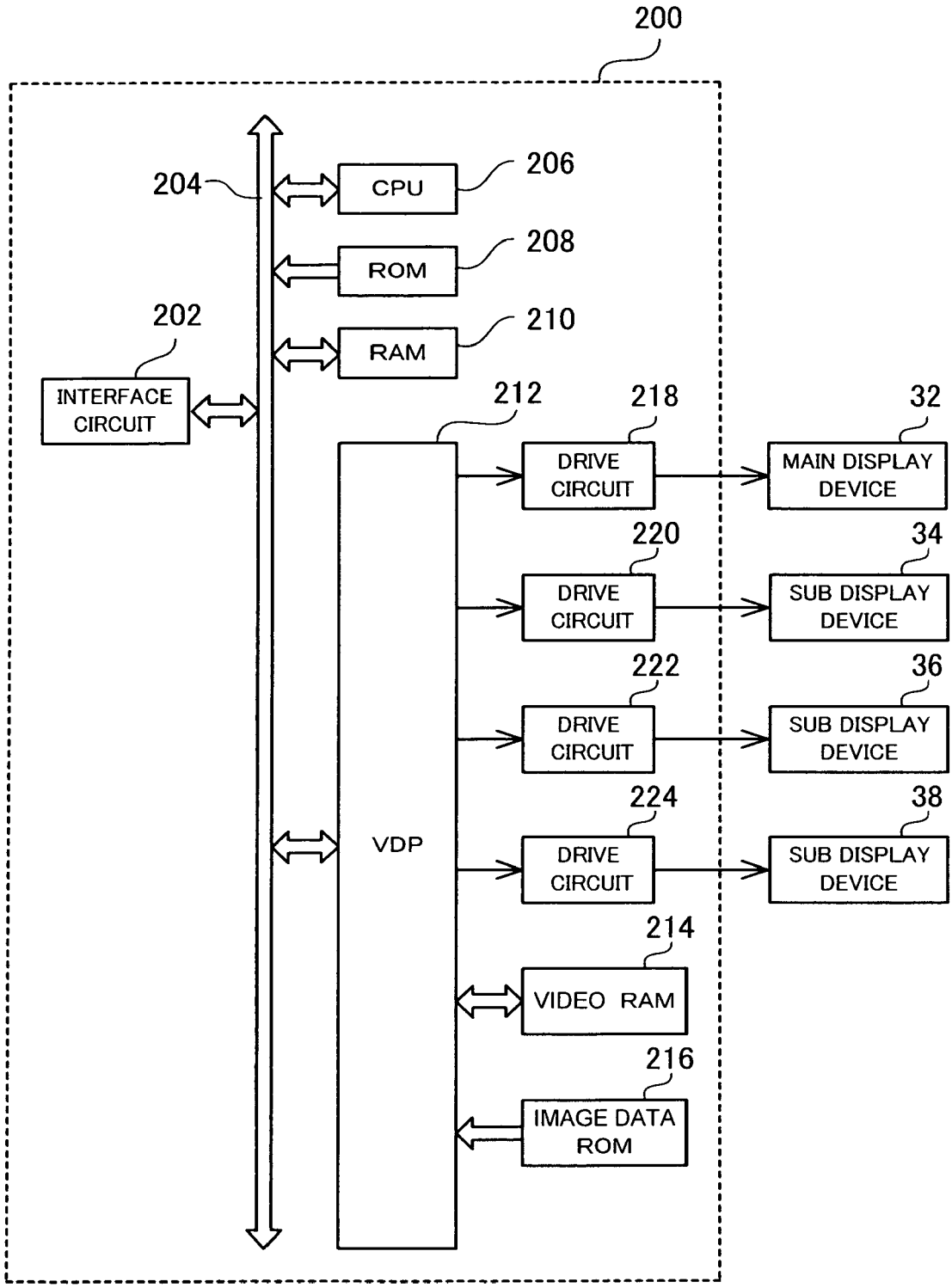
FIG. 5 is a block diagram showing an electrical configuration of a display control device of the gaming machine.

Next, with reference to FIG. 5, an electrical configuration of the display control device 200 will be described.

In the display control device 200, an interface circuit 202 is connected to an input-output bus 204. An image display command issued by the main control circuit 60 is supplied to the input-output bus 204 via the interface circuit 202. Through the input-output bus 204, a data signal or an address signal is inputted to or outputted from a CPU 206.

A ROM 208 and a RAM 210 are connected to the input-output bus 204. The ROM 208 stores therein a display control program for, based on an image display command issued by the main control circuit 60, generating a drive signal which will be supplied to the main display device 32. The RAM 210 stores therein flag and variable values which are used in the display control program.

A video data processor (VDP) 212 is also connected to the input-output bus 204. The VDP 212 is a processor which includes a so-called split circuit, a screen circuit, a palette circuit, and the like, and can perform processing for displaying an image on the main display device 32.

A video RAM 214 and an image data ROM 216 are connected to the VDP 212. The video RAM 214 stores therein image data corresponding to an image display command issued by the main control circuit 60. The image data ROM 216 stores therein data of images including a background image forming a background on the main display devices 32, symbol images which function as identification information, character images such as moving objects which are displayed as effect images, and the like. Also connected to the VDP 212 are a drive circuit 218 that issues a drive signal for driving the main display device 32, a drive circuit 220 that issues a drive signal for driving the sub display device 34, a drive circuit 222 that issues a drive signal for driving the sub display device 36, and a drive circuit 224 that issues a drive signal for driving the sub display device 38.

The CPU 206 reads out and conducts the display control program stored in the ROM 208 so that data of an image which will be displayed on the main display device 32 in accordance with an image display command issued by the main control circuit 60 is stored into the video RAM 214. The image display command issued by the main control circuit 60 includes background image display command, symbol image display command, character image display command, and the like.

The symbol image data, which are stored in the image data ROM 216 and used when symbols are variably displayed and stopped on the main display device 32, include image data corresponding to various display modes such as enlarged images, reduced images, and modified images. The character image data include image data needed for displaying characters in a mode of a series of actions.

Next, with reference to FIG. 6, description will be given to a concept of arrangement of image data to be stored in the video RAM 214.

Figure 6:
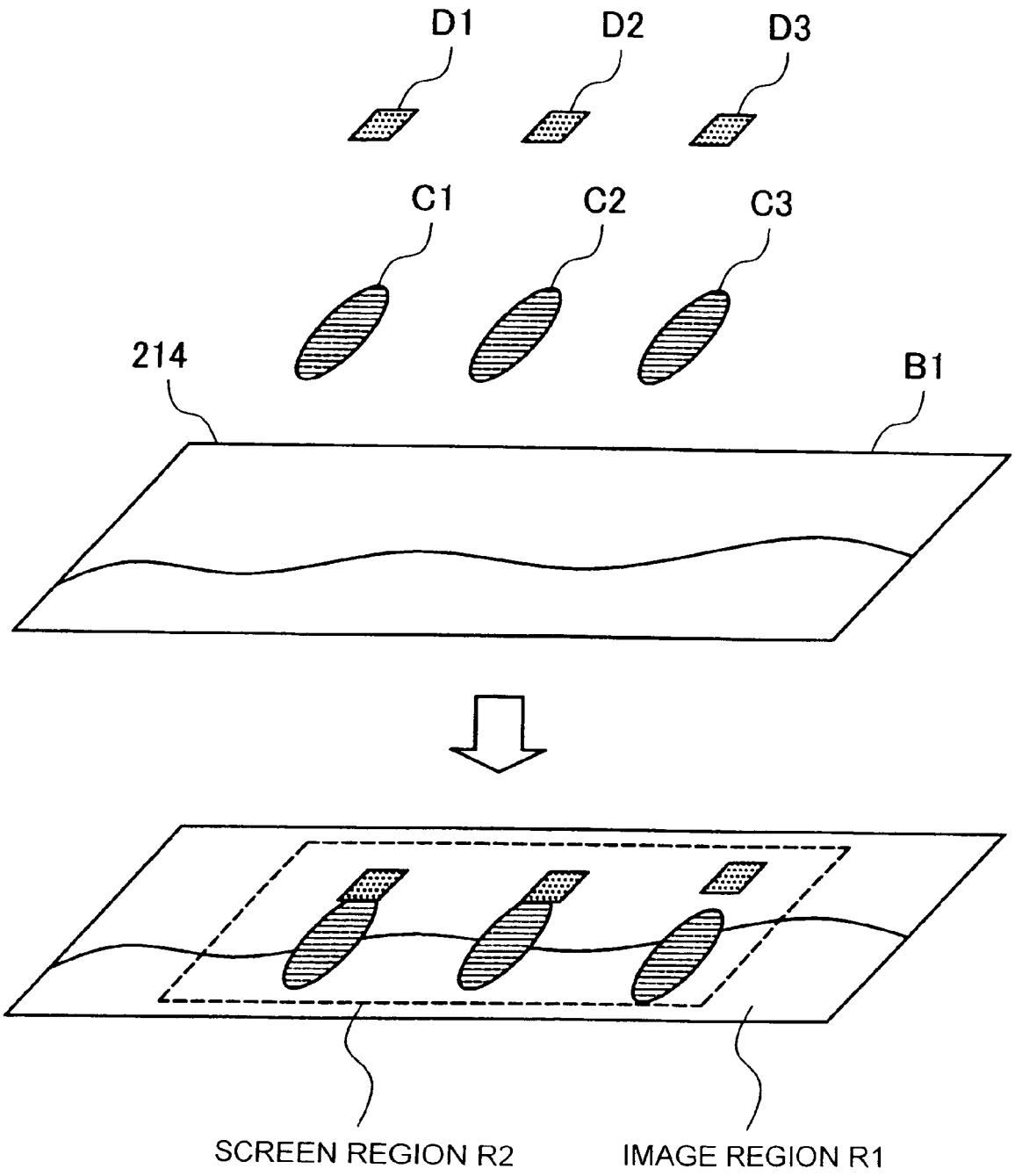
FIG. 6 shows a concept of arrangement of image data to be stored in a video RAM of the display control device.

As shown in FIG. 6, a size of an image region R1 (a region enclosed with a solid line) in which image data are stored upon an image display command is configured to be larger than a screen region R2 (a region enclosed with a broken line) corresponding to a screen of the main display device 32. This enables images to be smoothly scrolled on the screen of the main display device 32.

When the main control circuit 60 issues a symbol image display command, the VDP 212 reads out of the image data ROM 216 data of symbol images D1 to D3, and then places the read-out data at positions within the video RAM 214 corresponding to positions for the symbol images D1 to D3 to be displayed on the main display device 32, respectively.

When the main control circuit 60 issues a character image display command, the VDP 212 reads out of the image data ROM 216 data of character images C1 to C3, and then places the read-out data at positions within the video RAM 214 corresponding to positions for the character images C1 to C3 to be displayed on the main display device 32, respectively.

When the main control circuit 60 issues a background image display command, the VDP 212 reads out of the image data ROM 216 data of a background image B1, and then places the read-out data at a position within the video RAM 214 corresponding to a position for the background image B1 to be displayed on the main display device 32.

After the VDP 212 stores the image data into the video RAM 214 as described above, the VDP 212 reads out of the video RAM 214 only image data stored within the screen region R2, and supplies the read-out data via a display signal to the drive circuit 218.

Figure 7:
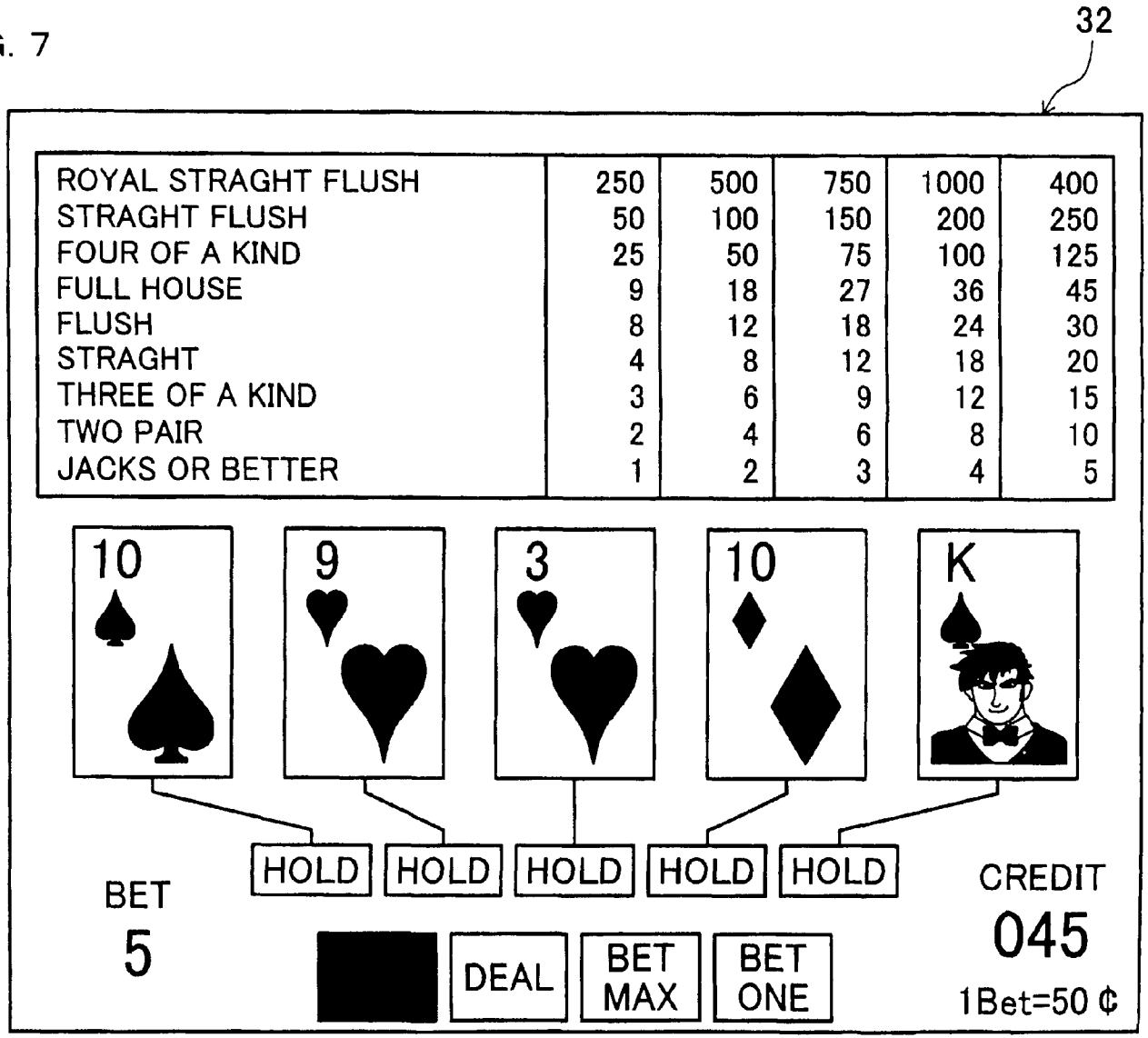
FIGS. 7, 8, and 9 show examples of a screen display on a main display device of the gaming machine.
Figure 8:
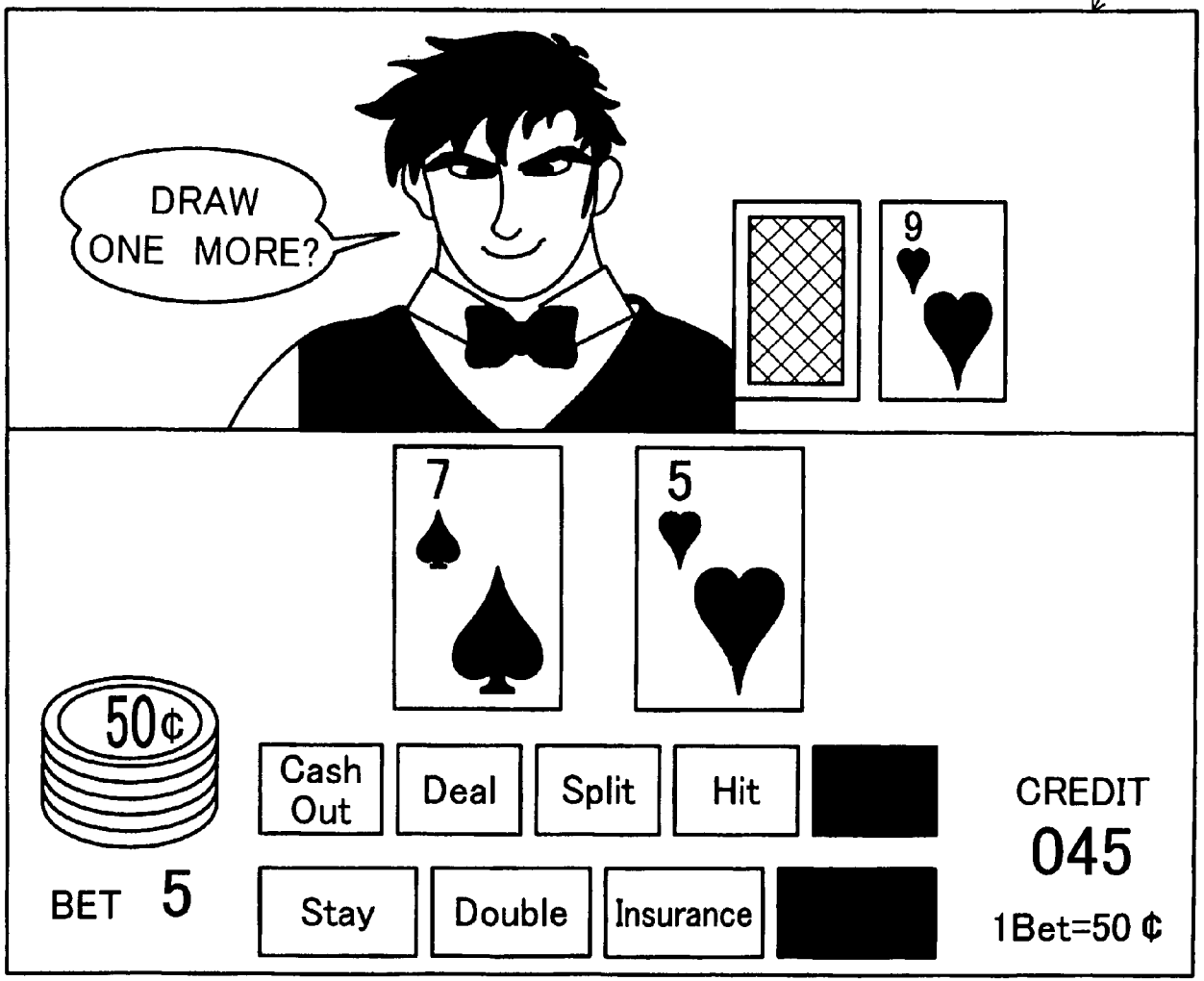
Figure 9:
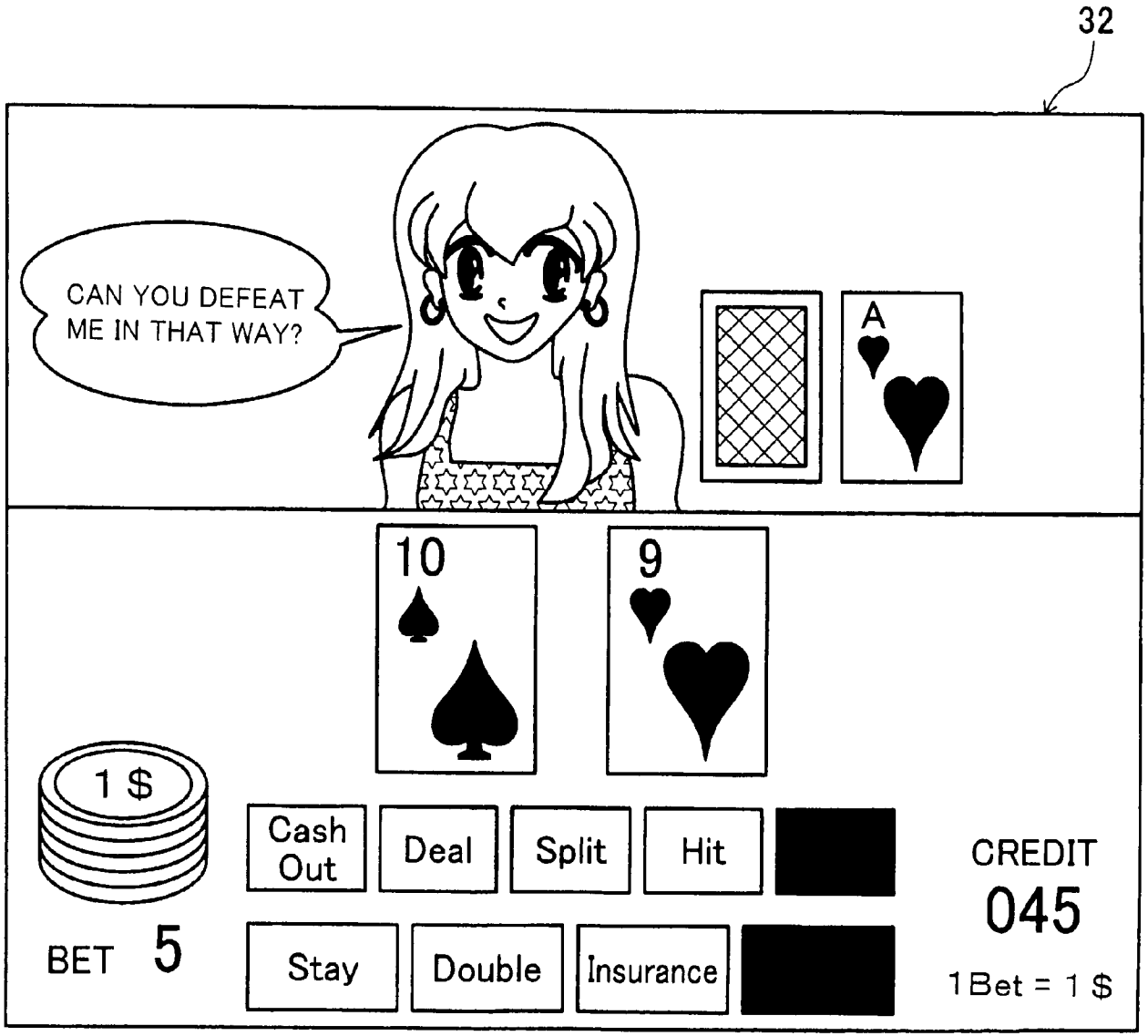

By storing image data into the video RAM 214, an image is displayed on the main display device 32 so that a game can progress. FIGS. 7, 8, and 9 show examples of a screen display on the main display device 32 during a game.

FIG. 7 exemplifies a screen display on the main display device 32 during a video-poker game. At a center of the screen, player's five cards are displayed in a row, and a game is performed with the cards.

At an upper part of the screen, combinations of cards for the poker game and the number of coins which will be paid out in accordance with a bet value are listed, so that a player can be informed of the number of coins which may be paid out.

Displayed at a lower center of the screen are rectangles in which other than one at the lower left words or phrases are written and which correspond to the switches 40, respectively. The word or phrase written in the rectangle represents a certain processing conducted by pressing a corresponding switch 40, so that a player can realize correspondences between switches 40 and operations in a case of a single gaming machine providing more than one games as this embodiment.

Displayed at lower, right and left of the screen are the number of coins bet on an ongoing game and the total number of coins inserted into the gaming machine 2 at the time, respectively. In addition, under the display of the total number of coins, shown is the kind of coin needed per one bet. In the example shown in FIG. 7, a player bet 5 coins on an ongoing game, the total number of coins inserted into the gaming machine 2 is 45 coins at the time, and the kind of coin needed per one bet is 50¢. The bet value on an ongoing game in FIG. 7 is 2$ 50¢ derived by multiplying 5 (number of bet coins) by 50¢ (the kind of coin needed per one bet).

FIGS. 8 and 9 exemplify a screen display on the main display device 32 during a black-jack game. At a center of the screen, player's two cards are displayed in a row, and a game is performed with the cards.

At an upper part of the screen, an animation of a virtual dealer and dealer's cards are displayed. Depending on a game condition, the virtual dealer says, for example, "DRAW ONE MORE?" as shown in FIG. 8 or "CAN YOU DEFEAT ME IN THAT WAY?" as shown in FIG. 9, so that the game progresses.

The gaming machine 2 includes more than two display programs for displaying an animation of a virtual dealer, which are different from a game program for the black-jack game, and can variably execute one the display programs while executing one of the game programs corresponding to the game (see FIGS. 8 and 9). Thus, even if the same game program is executed in the gaming machine 2, a player can feel as if he/she is playing a different kind of game by changing an appearance and a character of the virtual dealer. Due to this, the player can enjoy the game more variously.

Displayed at a lower center of the screen are rectangles in which other than the upper and lower right ones words or phrases are written and which correspond to the switches 40, respectively. The word or phrase written in the rectangle represents a certain processing which can be conducted by pressing a corresponding switch 40.

Displayed at lower, right and left of the screen are the number of coins bet on an ongoing game and the total number of coins inserted into the gaming machine 2 at the time, respectively. In addition, under the display of the total number of coins, shown is the kind of coin needed per one bet. An image of bet coins is also displayed, which increases a sense of reality.

In the examples shown in FIGS. 8 and 9, the kinds of coin needed per one bet are 50¢ and 1$, respectively. A program for setting the kind of coin needed per one bet is independent from the game program so that different kinds of coin can be inserted for betting even in the same game.

Figure 10:
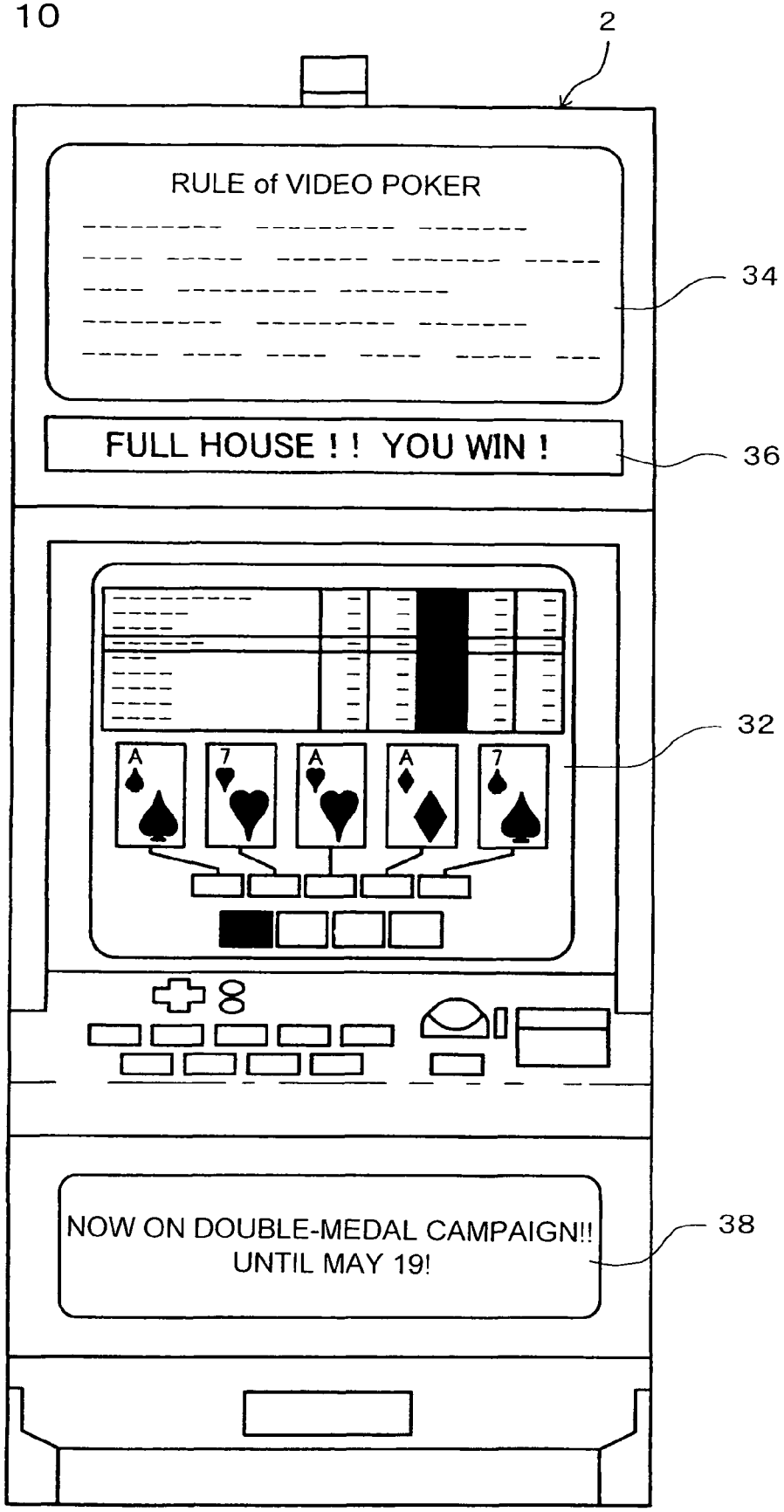
FIGS. 10 and 11 are front views of the gaming machine, showing exemplified screen displays on respective display devices of the gaming machine.

FIG. 10 is a front view of the gaming machine 2, showing exemplified screen displays on respective display devices 32, 34, 36, and 38 during a video-poker game. The main display device 32 displays a combination of cards making "full house". At this time, on the sub display device 36, a message such as "FULLHOUSE!! YOU WIN!!" flashes, thereby producing an effect as if the win of the player is being celebrated. The sub display device 34 displays the rule of the video-poker game, a program of which is currently executed, in order that a beginner may not miss an operation method.

The sub display device 38 displays an announcement from a game place: "NOW ON DOUBLE-MEDAL CAMPAIGN! UNTIL MAY 19!", and otherwise may display an advertisement or the like.

Figure 11:
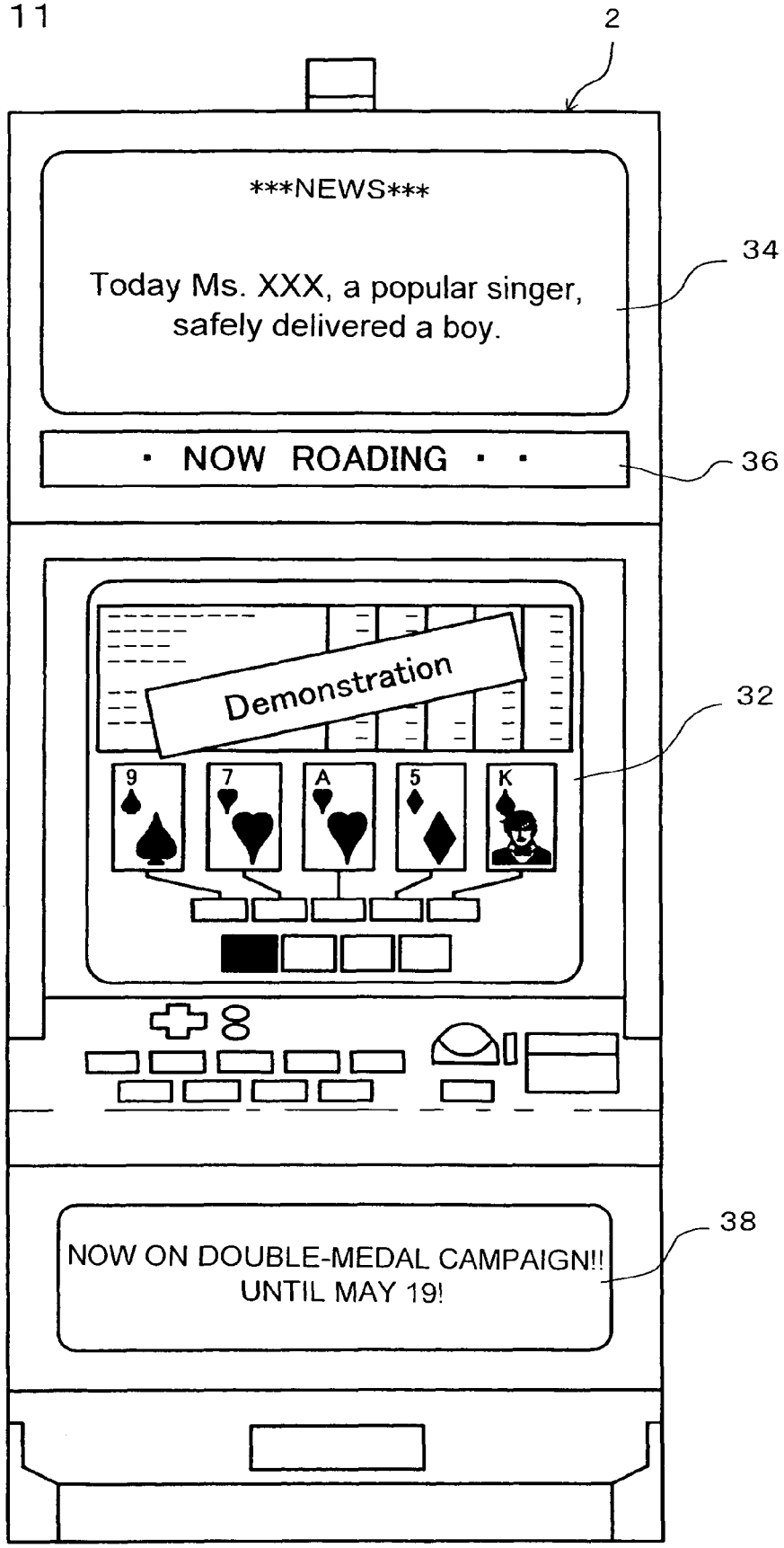

FIG. 11 schematically illustrates an exemplified front view of the gaming machine 2 while the game program is being downloaded. The main display device 32 displays a demonstration image of a game. Thereby, even while the game program is being written and no game cannot be played, a game place never lacks its bright mood which might otherwise be spoiled by displaying no image on the main display 32. In the sub display device 36 a text of "NOW ROADING" is scrolled from right to left of the screen, thereby announcing that the game program is being downloaded now.

The sub display device 34 displays text information on news, for example, so that various information can be given to players who stay the game place for a long time. This information can be kept displayed while the game program is being downloaded, and in addition can be displayed on the sub display device 36 or 38 as well.

The respective display devices 32, 34, 36, and 38 may display various images or information which are not limited to the above-described examples but may be music video images or environmental video images. Furthermore, the images or information may be displayed on a display device other than the devices 32, 34, 36, and 38.

Next, with reference to FIG. 12, a game program downloading processing will be described. Step is abbreviated to S in FIG. 12, and also in FIGS. 13 and 14 which will be described in detail later.

Figure 12:
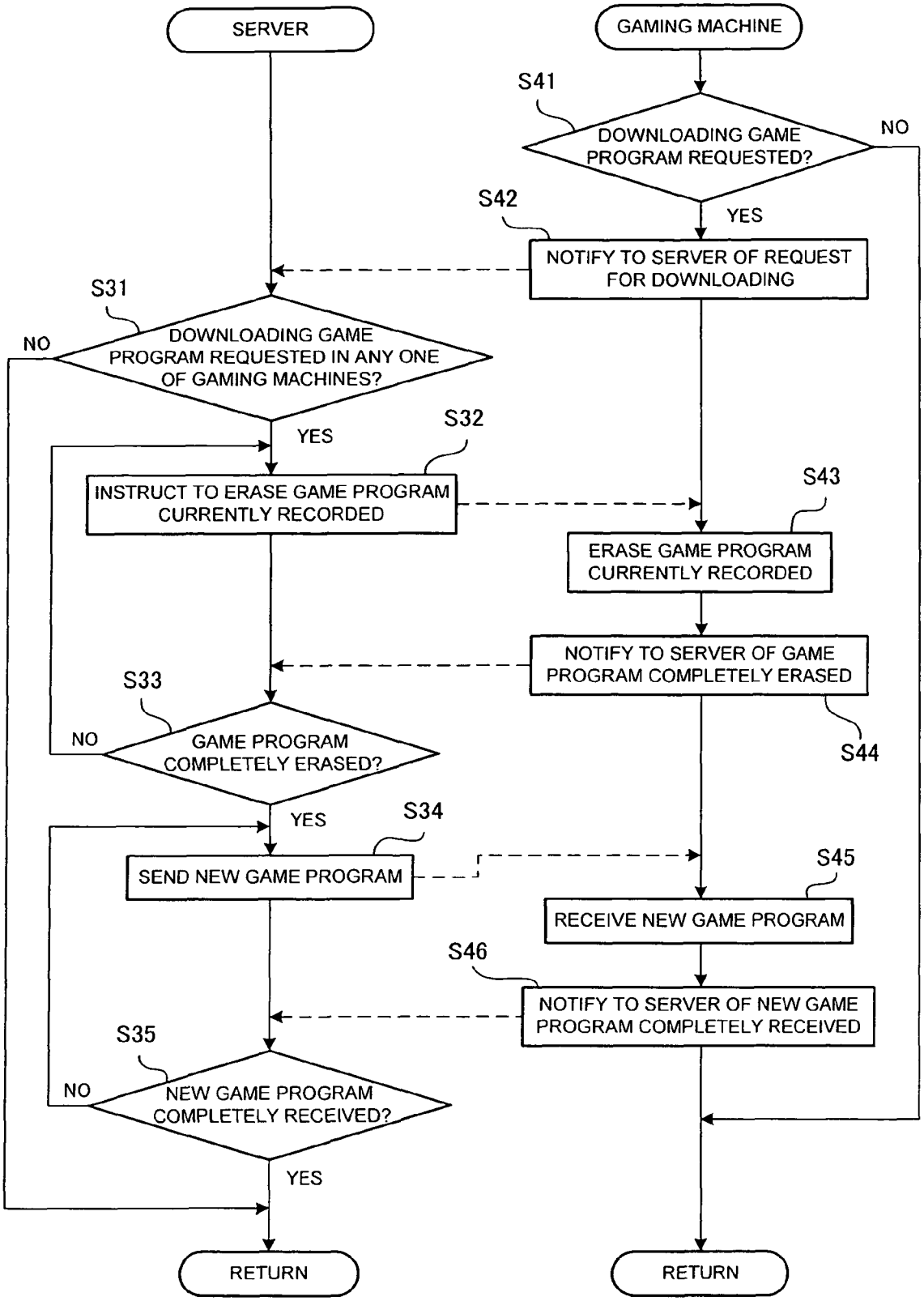
FIG. 12 is a flow chart of a game program downloading processing which is performed in the game system.

The game program to be downloaded in the processing in FIG. 12 is not limited to a program for controlling the game, but may be either one or a combination of the display control program and the program for setting the kind of coin needed per one bet.

The server 1 and the gaming machine 2 are started in advance, and two subroutines in FIG. 12 are accessed and executed by the server 1 and the gaming machine 2, respectively, at a predetermined timing. The subroutines are linked to each other by dashed arrows, which show that a processing in one subroutine is carried out on the basis of a result of a processing in the other subroutine. The two subroutines are independent from each other.

Here, the subroutine executed by the gaming machine 2 will be described.

In STEP 41, first, determined is whether or not downloading a game program is requested. More specifically, when a player desiring the change of a game selects a new game (i.e., a game program different from a game program currently recorded in the hard disk drive 74 of the gaming machine 2 at that time) while watching a game selection window, which is displayed on the main display device 32 of the gaming machine 2, a signal requesting the download is transmitted to the CPU 66 of the gaming machine 2 (see FIG. 4). The CPU 66 receiving the aforesaid signal performs STEP 42. If the aforesaid signal is not received, the CPU 66 ends this subroutine without any processing.

In STEP 42, the request for downloading a game program is notified to the server 1. More specifically, the CPU 66 transmits via the communication interface circuit 76 to the server 1 a signal indicating the request for the download and also data on the selected new game program, e.g., the name thereof. After this process, the CPU 66 performs STEP 43.

In STEP 43, a game program currently recorded in the hard disk drive 74 of the gaming machine 2 is erased. More specifically, the CPU 66 receives from the server 1 a signal transmitted in STEP 32, which is described later, and erases from the hard disk drive 74 the game program currently recorded therein. At the same time, the CPU 66 conducts a program, which is stored in the ROM 68, for displaying a demonstration image on the main display device 32 (see FIG. 11). The CPU 66 also conducts a program for displaying an indication that the game program is now being downloaded, e.g., "NOW ROADING" in FIG. 11, on the sub display device 36, and a program for displaying text information which is received via the communication interface circuit 76, e.g., information on news in FIG. 11, on the sub display device 34. After this process, the CPU 66 performs STEP 44.

In STEP 44, notified to the server 1 is that the game program is completely erased. More specifically, the CPU 66 transmits via the communication interface circuit 76 to the server 1 a signal indicating the completion of the erase. After this process, the CPU 66 performs STEP 45.

In STEP 45, the selected new game program is received from the server 1. More specifically, the CPU 66 records a new game program transmitted from the server 1 in STEP 34, which is described later, onto the hard disk drive 74 via the communication interface circuit 76. After this process, the CPU 66 performs STEP 46.

In STEP 46, notified to the server 1 is that the new game program is completely received. More specifically, the CPU 66 transmits via the communication interface circuit 76 to the server 1 a signal indicating the completion of the receipt. At the same time, the CPU 66 ends the program for displaying the demonstration image on the main display device 32, the program for displaying an indication that the game program is now being downloaded on the sub display device 36, and the program for displaying text information on the sub display device 34. After this process, the subroutine ends.

The display of the text information on the sub display device 34 may not necessarily be ended in the STEP 46, but may be kept until or even after the player starts a next play on the gaming machine 2.

Next, the subroutine executed by the server 1 will be described.

In STEP 31, first, determined is whether or not downloading a game program is requested in any one of the gaming machines 2. More specifically, the CPU 10 of the server 1 (see FIG. 2) determines whether or not the signal indicating the request for the download, which is transmitted in STEP 42, is received via the communication interface circuit 22 from any one of the gaming machines 2 which are connected via the network N. The CPU 10 receiving the aforesaid signal determines that the download is requested, and performs STEP 32. If the aforesaid signal is not received, the CPU 10 determines that the download is not requested, and ends this subroutine without any processing.

In STEP 32, an instruction to erase a game program currently recorded in the hard disk drive 74 is issued to the gaming machine 2. More specifically, the CPU 10 transmits via the communication interface circuit 22 to the gaming machine 2 a signal commanding that the game program currently recorded in the hard disk drive 74 should be erased therefrom. After this process, the CPU 10 performs STEP 33.

In STEP 33, determined is whether or not the game program is completely erased in the gaming machine 2. More specifically, the CPU 10 determines whether or not the signal indicating the completion of the erase, which is transmitted in STEP 44, is received from the gaming machine 2. The CPU 10 receiving the aforesaid signal determines that the game program is completely erased, and performs STEP 34. If the aforesaid signal is not received, the CPU 10 If the aforesaid signal is not received (e.g., when the game program is being erased or in a case where the signal commanding the erase is not properly transmitted to the gaming machine 2 in STEP 32 for some reason), the CPU 10 returns the processing to STEP 32.

In STEP 34, the selected new game program is transmitted to the gaming machine 2. More specifically, the CPU 10 accesses, among the game programs stored in the hard disk drive 18, a game program corresponding to the data transmitted from the gaming machine 2 in STEP 42, and then forwards this game program via the communication interface circuit 22 to the gaming machine 2. After this process, the CPU 10 performs STEP 35.

In STEP 35, determined is whether or not that the new game program is completely received in the gaming machine 2. More specifically, the CPU 10 determines whether or not the signal indicating the completion of the receipt, which is transmitted in STEP 46, is received from the gaming machine 2. The CPU 10 receiving the aforesaid signal determines that the new game program is completely received, and ends this subroutine. If the aforesaid signal is not received (e.g., when the new game program is being received or in a case where the new game program is not properly transmitted to the gaming machine 2 in STEP 34 for some reason), the CPU 10 returns the processing to STEP 34.

Figure 13:
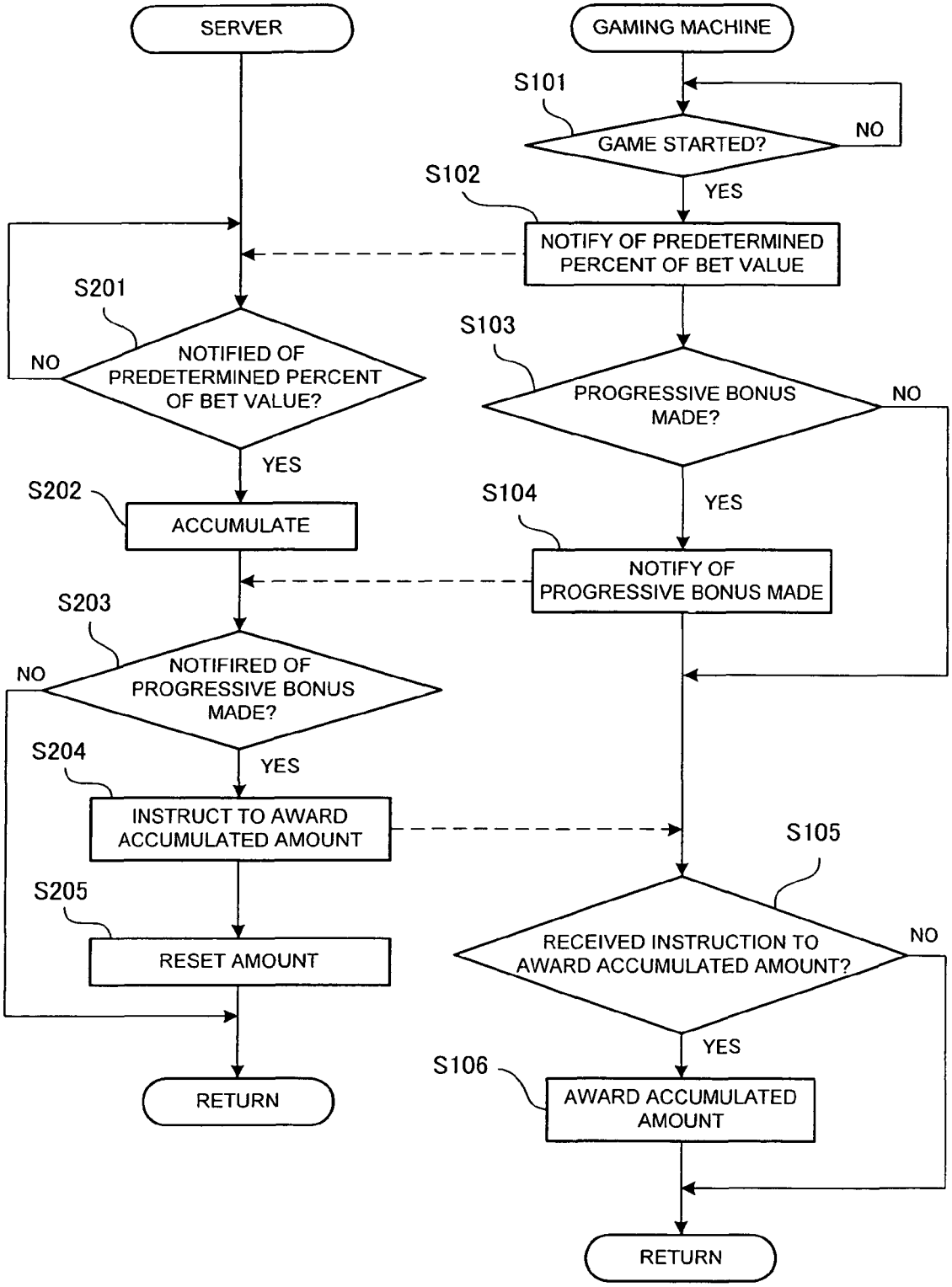
FIGS. 13 and 14 are flow charts of a processing which is performed in the game system with a game program being executed.
Figure 14:
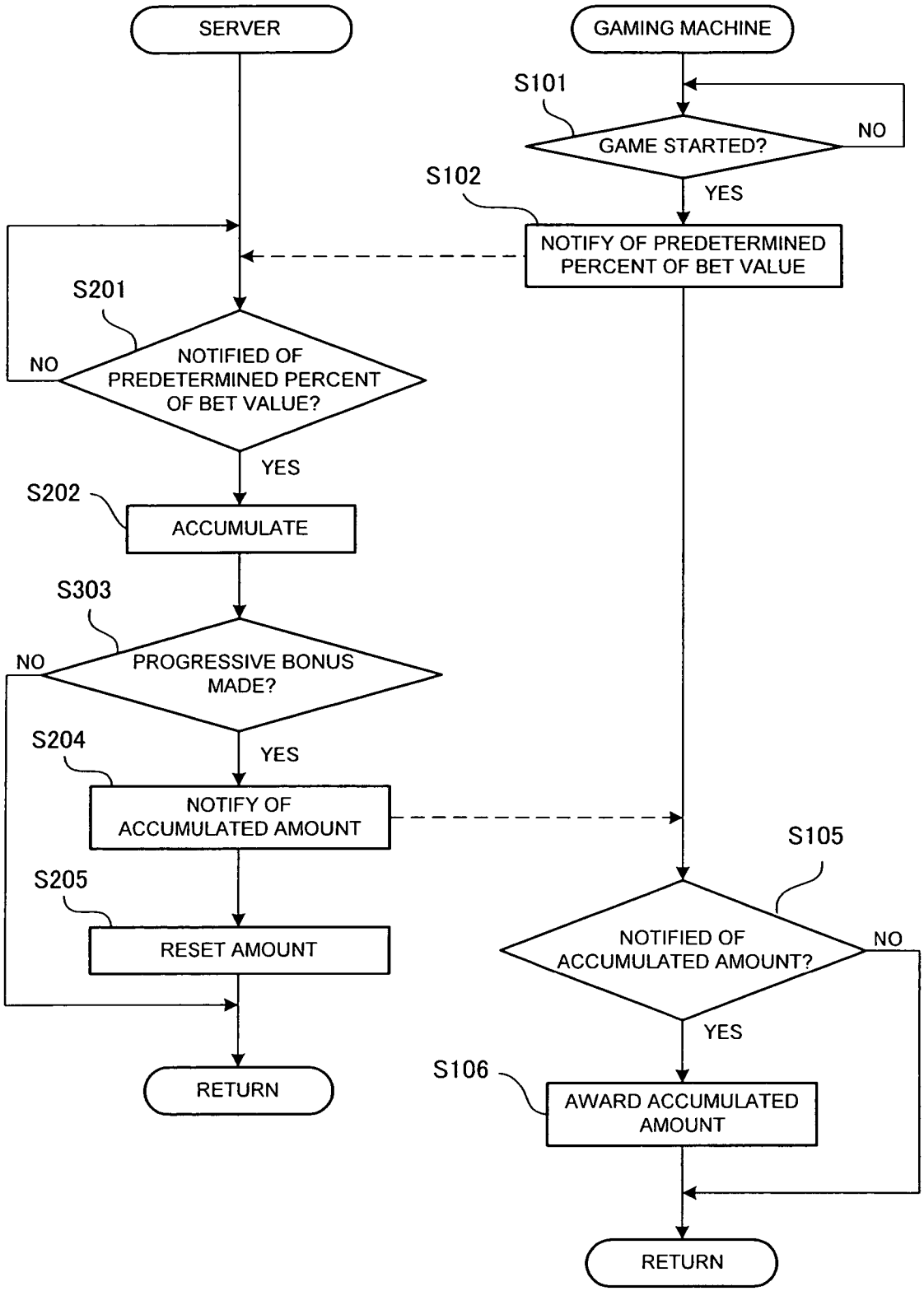

Next, with reference to FIGS. 13 and 14, a description will be given to a processing which is performed in the game system of this embodiment with a game program being executed. The processings in FIGS. 13 and 14 are different in which of the gaming machine 2 and the server 1 determines whether a progressive bonus is made or not: the gaming machine 2 in FIG. 13 and the server 1 in FIG. 14 does.

Here, the processing shown in FIG. 13 will be described.

In STEP 101, first, the CPU 66 of the gaming machine 2 determines whether a game is started or not. The CPU 66 determining that a game is not started (STEP 101: NO) repeats the same determination. The CPU 66 determining that a game is started (STEP 101: YES) performs STEP 102.

In STEP 102, the CPU 66 of the gaming machine 2 notifies a predetermined percent of a bet value to the server 1. The predetermined percent of the bet value may be equal in all of the gaming machine 2, or alternatively may be determined depending on the kind of games played on the gaming machine 2 or a value of a game medium (i.e., the kind of coin) needed per one bet. In a case where the predetermined percent is not equal in all the gaming machines 2 but determined depending on the kind of games played on the gaming machine 2 or a value of a game medium needed per one bet, players can more enjoy the games having varieties. For example, the predetermined percents for a poker game and a black-jack game may be progressively set at 1% and 3%, respectively, in a case where the kinds of coin needed per one bet are 50¢ (see FIG. 7) for a poker game and 1$ (see FIG. 9) for a black-jack game. Accordingly, the predetermined percent of the bet value may be varied even in the same game; depending on the kind of coin needed per one bet, e.g., 50¢ in FIGS. 8 and 1$ in FIG. 9 which are different from each other even in the same black-jack game.

The CPU 10 of the server 1 performs STEP 201 to determine whether or not the predetermined percent of the bet value is notified from any of the gaming machines 2. The CPU 10 determining that the predetermined percent of the bet value is notified from none of the gaming machines 2 (STEP 201: NO) repeats the same determination. The CPU 10 determining that the predetermined percent of the bet value is notified from any of the gaming machines 2 (STEP 201: YES) performs STEP 202, thereby accumulating the predetermined percent of the bet value and recording the value in the RAM 16. Here, CPU 10 accumulates the predetermined percent of the bet value on each of the gaming machines 2 executing a game program at the time, regardless of the kind of game programs.

The predetermined percent of the bet value is not limited to be computed by the CPU 66 of the gaming machine 2 but may be computed by the CPU 10 of the server 1. For example, the CPU 66 of the gaming machine 2 may notify only a bet value to the server 1 in STEP 102, and the CPU 10 of the server 1 receiving the bet value may compute the predetermined percent of the bet value.

The CPU 66 of the gaming machine 2 performs STEP 103, to determine whether a progressive bonus is made or not, which may be determined by a lottery using the random number generator 78 or alternatively determined based on a result of the game with a winning combination for the progressive bonus preset. In the poker game, for example, one of the combinations of the poker game may be employed as a winning combination for the progressive bonus, or alternatively an original winning combination for the progressive bonus can be set. Moreover, the determination may be made based on a combination of cards completed after a deal.

The CPU 66 of the gaming machine 2 determining that the progressive bonus is made (STEP 103: YES) performs STEP 104 to notify the progressive bonus made to the server 1. Thereafter, the CPU 66 performs STEP 105. The CPU 66 determining that the progressive bonus is not made (STEP 103: NO) performs STEP 105 without performing STEP 104.

Meanwhile, the CPU 10 of the server 1 performs STEP 203, to determine whether or not any of the gaming machines 2 notifies the progressive bonus made. The CPU 10 determining that none of the gaming machines 2 notifies the progressive bonus made (STEP 203: NO) ends this subroutine. The CPU 10 determining that any of the gaming machines 2 notifies the progressive bonus made (STEP 203: YES) performs STEP 204 to issue to the gaming machine 2 an instruction to award an accumulated amount the value of which is recorded in the RAM 16 of the server 1. In subsequent STEP 205 the amount is reset, and then this subroutine is ended.

The awarded amount which is issued by the CPU 10 and notified to the gaming machine 2 may be the sum total of accumulated amount at that time or alternatively be a part thereof.

Figure 15:
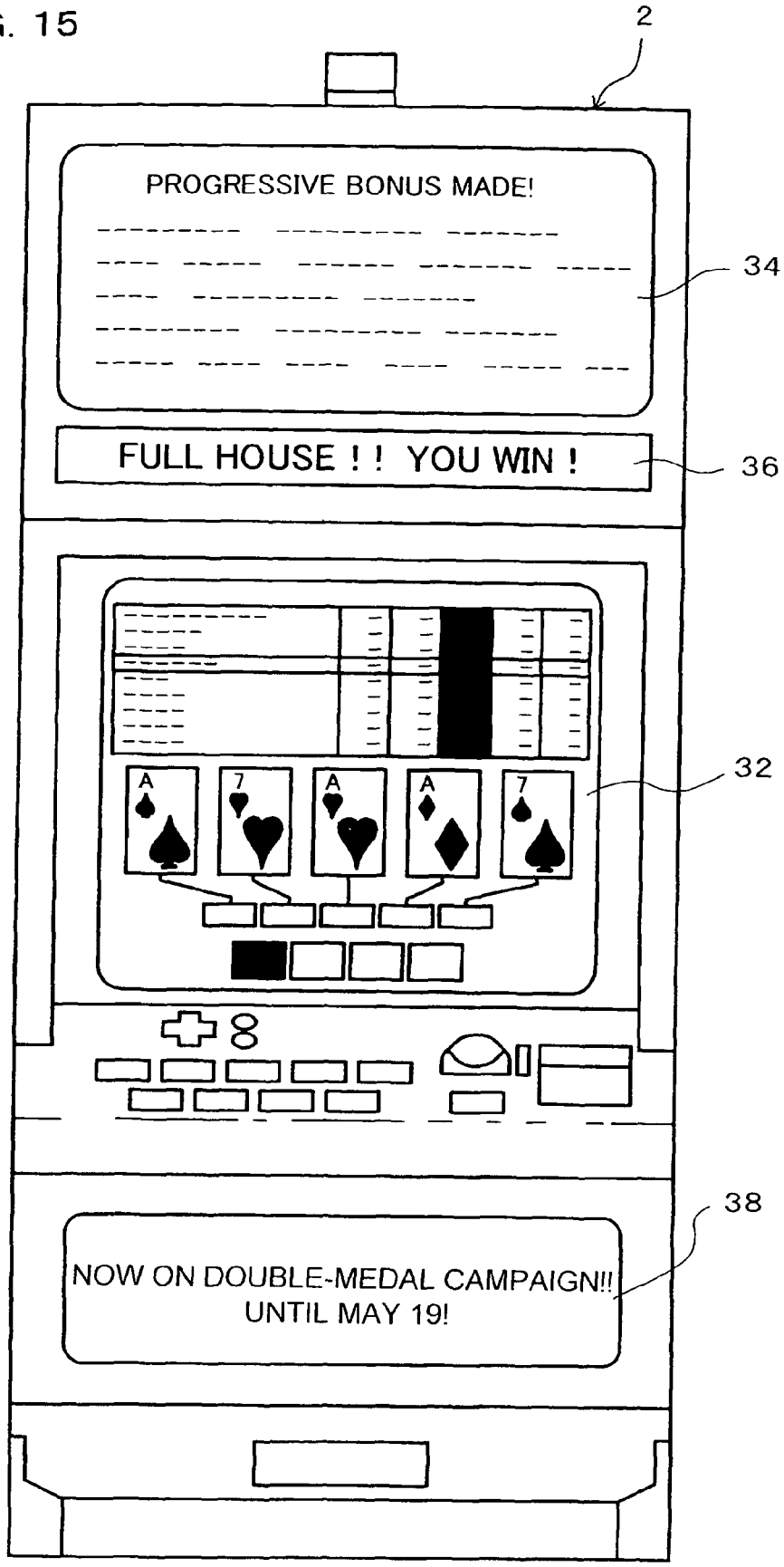
FIGS. 15 and 16 are front views of the gaming machine, showing exemplified screen displays on the respective display devices of the gaming machine.
Figure 16:
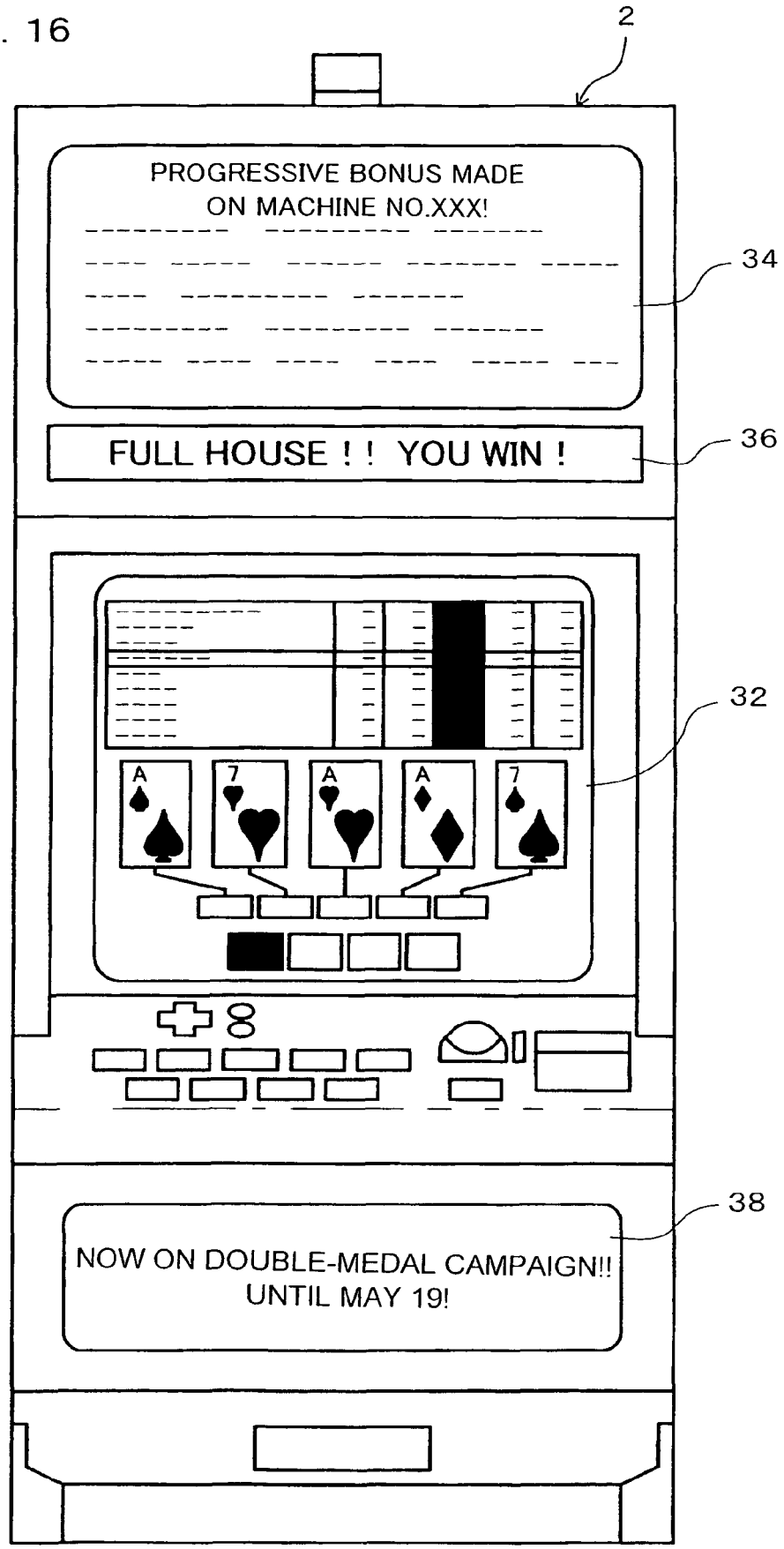
Figure 17:
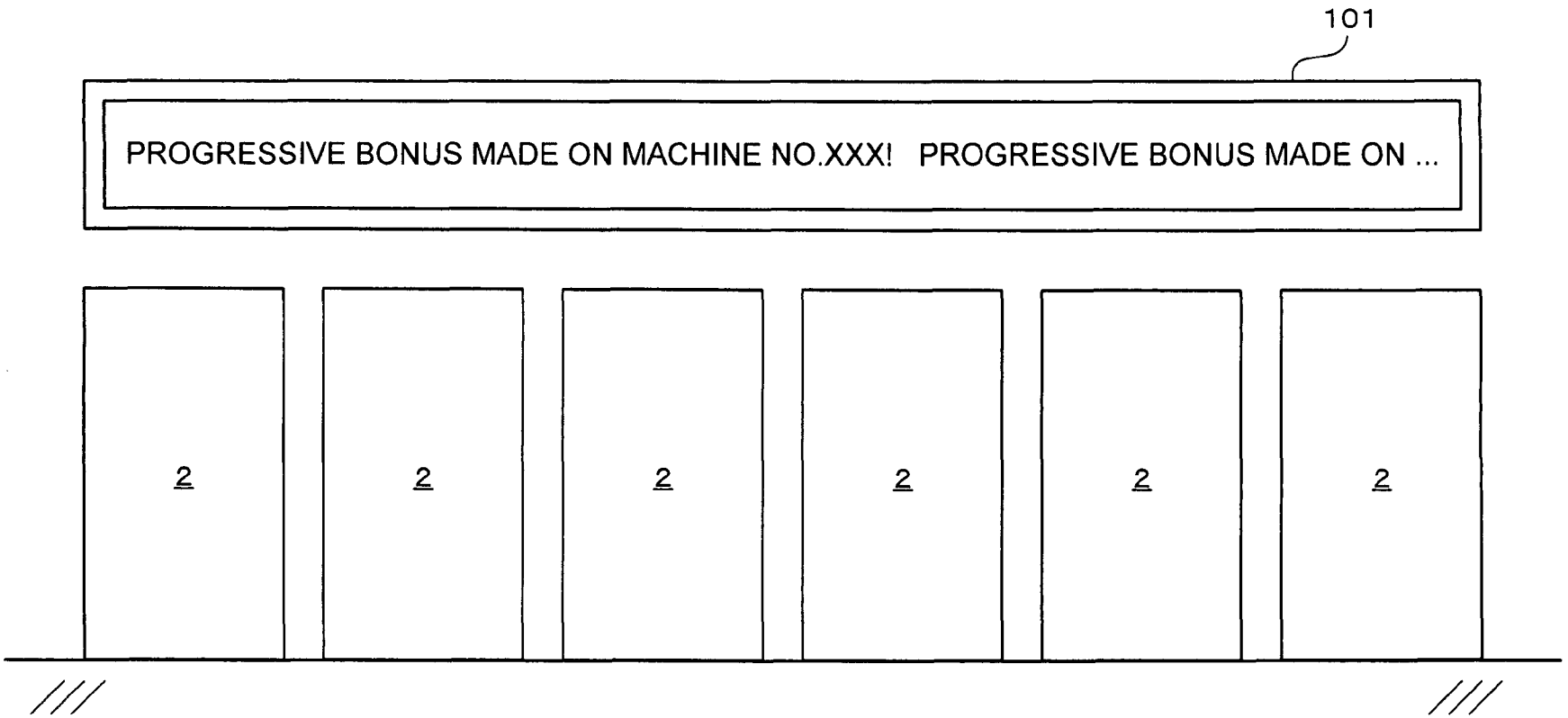
FIG. 17 is a front view showing an example in which a large monitor is provided.

When the CPU 10 of the server 1 determines that any of the gaming machines 2 notifies the progressive bonus made (STEP 203: YES), the CPU 10 may command the gaming machine 2 making the progressive bonus to display a message such as "PROGRESSIVE BONUS MADE!", as shown in FIG. 15. Further, the CPU 10 may command gaming machines other than the gaming machine 2 making the progressive bonus to display a message such as "PROGRESSIVE BONUS MADE ON MACHINE NO. XXX!", as shown in FIG. 16. The massage may be displayed on any gaming machines 2, on which no game or some game different from the game on the gaming machine 2 making the progressive bonus is being played. As shown in FIG. 17, a large monitor 101 visible to every players playing on the gaming machines 2 may be provided and controlled to display a message such as "PROGRESSIVE BONUS MADE ON MACHINE NO. XXX!", which may be scrolled.

Meanwhile, the CPU 66 of the gaming machine 2 performs STEP 105, to determine whether or not an instruction to award the accumulated amount is received from the server 1. The CPU 66 determining that the instruction to award the accumulated amount is not received (STEP 105: NO) ends this subroutine. The CPU 66 determining that the instruction to award the accumulated amount is received (STEP 105: YES) performs STEP 106, thereby awarding the accumulated amount. Thereafter, this subroutine is ended.

In the processing shown in FIG. 13 the CPU 10 of the server 1 functions as "the accumulating device" when performing STEP 202, and as "the awarding device" when performing STEP 204.

Next, the processing shown in FIG. 14 will be described. The description about the same STEPS as in FIG. 13 will be omitted herein.

In the processing shown in FIG. 14, the gaming machine 2 does not perform the above STEPS 103 and 104 and the server 1 performs STEP 303, which corresponds to STEP 103, instead of STEP 203. More specifically, the CPU 10 of the server 1 determines in STEP 303 whether a progressive bonus is made or not on any of the gaming machines 2, by a lottery using the random number generator 78, for example.

The CPU 10 of the server 1 determining that the progressive bonus is made on none of the gaming machines 2 (STEP 303: NO) ends the subroutine. On the other hand, the CPU 10 determining that the progressive bonus is made on any of the gaming machines 2 (STEP 303: YES) performs STEP 204 to issue to the gaming machine 2 an instruction to award the accumulated amount. Then, the CPU 66 of the gaming machine receiving the instruction (STEP 105: YES) performs STEP 106 to award the accumulated amount, and ends the subroutine. Meanwhile, the CPU 10 of the server 1 performs STEP 205, after performing STEP 204, to reset the amount and then ends the subroutine.

In the processing shown in FIG. 14 the CPU 10 of the server 1 functions as "the accumulating device" when performing STEP 202, and as "the awarding device" when performing STEP 204.

As described above, thus far in the game system of this embodiment, a predetermined percent of a bet value on each of the gaming machines 2 is accumulated (STEP 202), and the accumulated amount is awarded (STEP 204) to any of the gaming machines 2 satisfying a predetermined game condition (making the progressive bonus in the embodiment), regardless of the kind of game programs recorded in the gaming machines 2. As a result, even a player who plays a relatively unfavored or unpopular game can obtain a large amount as a bonus.

The gaming machine 2 can selectably execute one of game programs including a poker game program, a black-jack game program, etc. The game program executable by the gaming machine 2 is not limited to such card game programs but may be slot game programs. For example, a game program selected from various slot game programs such as three-reel and five-reel game programs may be executed. Further, a game program selected from various genres of game programs such as card game programs and slot game programs may also be selectably executed in the gaming machine 2.

The progressive bonus may be a so-called jackpot.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A game system, comprising:

a server; and a plurality of gaming machines connected to the server via a network, each gaming machine having a display device and a storage device storing a game program for controlling a single kind of game, a display program for displaying an image on the display device, and a coin setting program for setting a kind of coin needed per one bet, the plurality of gaming machines running said single kind of game by executing the game program and the coin setting program, wherein the server stores a plurality of game programs for controlling different kinds of games, a plurality of display programs for displaying an image on the display device, and a plurality of coin setting programs for setting different kinds of coin needed per one bet, and at least one of the plurality of gaming machines executes a rewriting process of downloading at least one of the plurality of game programs, the plurality of display programs, and the plurality of coin setting programs from the server based on selection by a player and rewriting the storage device by the downloaded at least one of the programs, if in the rewriting process the game program stored in the storage device is not rewritten whereas the display program is rewritten, said at least one of the plurality of gaming machines runs the single kind of game while changing the image displayed on the display device to an image indicated by the display program thus rewritten but not changing the kind of game, if in the rewriting process the game program stored in the storage device is not rewritten whereas the coin setting program is rewritten, said at least one of the plurality of gaming machines runs the single kind of game while changing the kind of coin needed per one bet based on the coin setting program thus rewritten but not changing the kind of game, each gaming machine includes a determining device which selects a predetermined ratio from among a plurality of ratios according to the kind of coin needed per one bet which is set based on the coin setting program stored in the storage device, and an accumulating device which accumulatively stores a bonus resource in the server, the resource being a part of a bet credit value pooled according to the predetermined ratio selected by the determining device, and the server includes a storage device that collects and accumulatively stores the resource from each gaming machine according to the predetermined ratio set based on the coin setting program stored in the storage device, and an awarding device that awards an amount of resource accumulated by the accumulating device to any of the gaming machines satisfying a predetermined game condition.

2. The game system according to claim 1, wherein each gaming machine further comprises: a device which determines whether the predetermined condition is met, based on a result of a game of a game program executed therein.

3. The game system according to claim 1, wherein, when a program is being downloaded in a gaming machine, a demonstration image of a game associated with the program being downloaded is displayed on the display device of the gaming machine indicating that the program is being downloaded.

4. The game system according to claim 1, wherein, the display program is a program for displaying a virtual dealer on the display device, and if in the rewriting process the game program stored in the storage device is not rewritten but the display program is rewritten, said at least one of the plurality of gaming machines runs the single kind of game while changing the virtual dealer displayed on the display device to a virtual dealer indicated by the display program thus rewritten but not changing the kind of game.

5. A game system comprising:

a server; and a plurality of gaming machines connected to the server via a network, each gaming machine having a display device and a storage device storing a game program for controlling a single kind of game, a display program for displaying an image on the display device, and a coin setting program for setting a kind of coin needed per one bet, the plurality of gaming machines running said single kind of game by executing the game program and the coin setting program, wherein the server stores a plurality of game programs for controlling different kinds of games, a plurality of display programs for displaying an image on the display device, and a plurality of coin setting programs for setting different kinds of coins needed per one bet, and at least one of the plurality of gaming machines executes a rewriting process of downloading at least one of the plurality of game programs, the plurality of display programs, and the plurality of coin setting programs from the server based on selection by a player and rewriting the storage device by the downloaded at least one of the programs, if in the rewriting process the game program stored in the storage device is not rewritten whereas the display program is rewritten, said at least one of the plurality of gaming machines runs the single kind of game while changing the image displayed on the display device to an image indicated by the display program thus rewritten but not changing the kind of game, if in the rewriting process the game program stored in the storage device is not rewritten whereas the coin setting program is rewritten, said at least one of the plurality of gaming machines runs the single kind of game while changing the kind of coin needed per one bet based on the coin setting program thus rewritten but not changing the kind of game, each gaming machine includes a setting device which sets a credit value required in one bet for each kind of the game programs executable therein, a determining device which selects a predetermined ratio from among a plurality of ratios according to the setting of the credit value required in one bet which is set based on the coin setting program stored in the storage device, and an accumulating device which accumulatively stores a bonus resource in the server, the resource being a part of a bet credit value pooled according to the predetermined ratio selected by the determining device, and the server includes a storage device that collects and accumulatively stores the resource from each gaming machine according to the predetermined ratio set based on the coin setting program stored in the storage device, and an awarding device that awards an amount of resource accumulated by the accumulating device to any of the gaming machines satisfying a predetermined game condition.

6. The game system according to claim 5, wherein the plurality of game programs include a program which sets the credit value required in one bet in the gaming machine.

7. The game system according to claim 5, wherein each gaming machine further comprises: a device which determines whether the predetermined condition is met, based on a result of a game of a game program executed therein.

8. The game system according to claim 5, wherein, when a program is being downloaded in a gaming machine, a demonstration image of a game associated with the program being downloaded is displayed on the display device of the gaming machine indicating that the program is being downloaded.

9. The game system according to claim 5, wherein, the display program is a program for displaying a virtual dealer on the display device, and if in the rewriting process the game program stored in the storage device is not rewritten but the display program is rewritten, said at least one of the plurality of gaming machines runs the single kind of game while changing the virtual dealer displayed on the display device to a virtual dealer indicated by the display program thus rewritten but not changing the kind of game.

10. A game system comprising:

a server; and a plurality of gaming machines configured to run different programs and connected to the server via a network, each gaming machine having a display device and a storage device storing a game program for controlling a single kind of game, a display program for displaying an image on the display device, and a coin setting program for setting a kind of coin needed per one bet, the plurality of gaming machines running said single kind of game by executing the game program and the coin setting program, wherein the server stores a plurality of game programs for controlling different kinds of games, a plurality of display programs for displaying an image on the display device, and a plurality of coin setting programs for setting different kinds of coins needed per one bet, and at least one of the plurality of gaming machines executes a rewriting process of downloading at least one of the plurality of game programs, the plurality of display programs and the plurality of coin setting programs from the server based on selection by a player and rewriting the storage device by the downloaded at least one of the programs, if in the rewriting process the game program stored in the storage device is not rewritten whereas the display program is rewritten, said at least one of the plurality of gaming machines runs the single kind of game while changing the image displayed on the display device to an image indicated by the display program thus rewritten but not changing the kind of game, if in the rewriting process the game program stored in the storage device is not rewritten whereas the coin setting program is rewritten, said at least one of the plurality of gaming machines runs the single kind of game while changing the kind of coin needed per one bet based on the coin setting program thus rewritten but not changing the kind of game, each gaming machine includes a determining device which selects a predetermined ratio from among a plurality of ratios according to the kind of coin needed per one bet which is set based on the coin setting program stored in the storage device, and an accumulating device which accumulatively stores a bonus resource in the server, the resource being a part of a bet credit value pooled according to the predetermined ratio selected by the determining device, and the server includes a storage device that collects and accumulatively stores the resource from each gaming machine according to the predetermined ratio based on the coin setting program stored in the storage device, and an awarding device that awards an amount of resource accumulated by the accumulating device to any of the gaming machines satisfying a predetermined game condition.

11. The game system according to claim 10 wherein each gaming machine further comprises: a device which determines whether the predetermined condition is met based on a result of a game of a game program executed therein.

12. The game system according to claim 10, wherein each gaming machine further includes a setting device which sets, for each kind of the game programs executable therein, a credit value required in one bet, and the determining device selects the predetermined ratio according to the setting of the credit value required in one bet.

13. The game system according to claim 10, wherein each gaming machine further comprises;

a setting device which sets, for each kind of the game programs executable therein, a credit value required in one bet, the determining device selects the predetermined ratio according to the setting of the credit value required in one bet, and the plurality of game programs include a program which sets the credit value required in one bet in the gaming machine.

14. The game system according to claim 10, wherein, when a program is being downloaded in a gaming machine, a demonstration image of a game associated with the program being downloaded is displayed on the display device of the gaming machine indicating that the program is being downloaded.

15. The game system according to claim 10, wherein, the display program is a program for displaying a virtual dealer on the display device, and if in the rewriting process the game program stored in the storage device is not rewritten but the display program is rewritten, said at least one of the plurality of gaming machines runs the single kind of game while changing the virtual dealer displayed on the display device to a virtual dealer indicated by the display program thus rewritten but not changing the kind of game.

* * * * *